United States Patent [19]

Vysokorodov

[11] 4,068,979

[45] Jan. 17, 1978

[54] MARINE PROPULSIVE DEVICE

[76] Inventor: Nikolai Sergeevich Vysokorodov, prospekt Stachek, 75, kv. 169, Leningrad, U.S.S.R.

[21] Appl. No.: 615,204

[22] Filed: Sept. 22, 1975

[30] Foreign Application Priority Data

July 26, 1973 U.S.S.R. ..... 1950482

[51] Int. Cl.[2] ..... B63H 1/26

[52] U.S. Cl. ..... 416/207; 416/244 B

[58] Field of Search ..... 416/204, 205, 207, 244 R, 416/219, 248, 166, 168; 403/15; 115/17, 18 R, 34 R, 35; 29/156.8 P; 308/237 R, 237 A

[56] References Cited

U.S. PATENT DOCUMENTS

| | | | |
|---|---|---|---|
| 2,946,610 | 7/1960 | Jennes | 416/244 |
| 3,698,836 | 10/1972 | Herbage | 416/244 |

FOREIGN PATENT DOCUMENTS

| | | | |
|---|---|---|---|
| 1,922,834 | 11/1970 | Germany | 416/166 |
| 242,697 | 6/1971 | U.S.S.R. | 416/244 |

*Primary Examiner*—Trygve M. Blix

*Assistant Examiner*—Jesus D. Sotelo

*Attorney, Agent, or Firm*—Fleit & Jacobson

[57] ABSTRACT

This invention relates to marine propulsive devices, wherein the propeller drive shaft is dismantled outwards. The herein-proposed marine propulsive device comprises a propeller drive shaft carrying at one end a screw propeller that has a hub with radial holes to hold the propeller blade roots, the propeller hub being made as a sleeve fitted onto the propeller drive shaft extension in such a manner that a free space is defined between an end portion of the sleeve and the butt end of the propeller drive shaft, the space being communicated with the hub outside surface and adapted for feeding a liquid under pressure thereinto in the course of hub dismantling; each of the radial holes in the screw propeller hub is open-ended, and a socket coaxial with its respective hole is provided in the propeller drive shaft, the socket being adapted for holding the end of the propeller blade root. Such a construction of the herein-proposed marine propulsive device enables its mounting or dismantling in the course of manufacture or repairs to be simplified and accelerated.

2 Claims, 2 Drawing Figures

MARINE PROPULSIVE DEVICE

Figure 1:
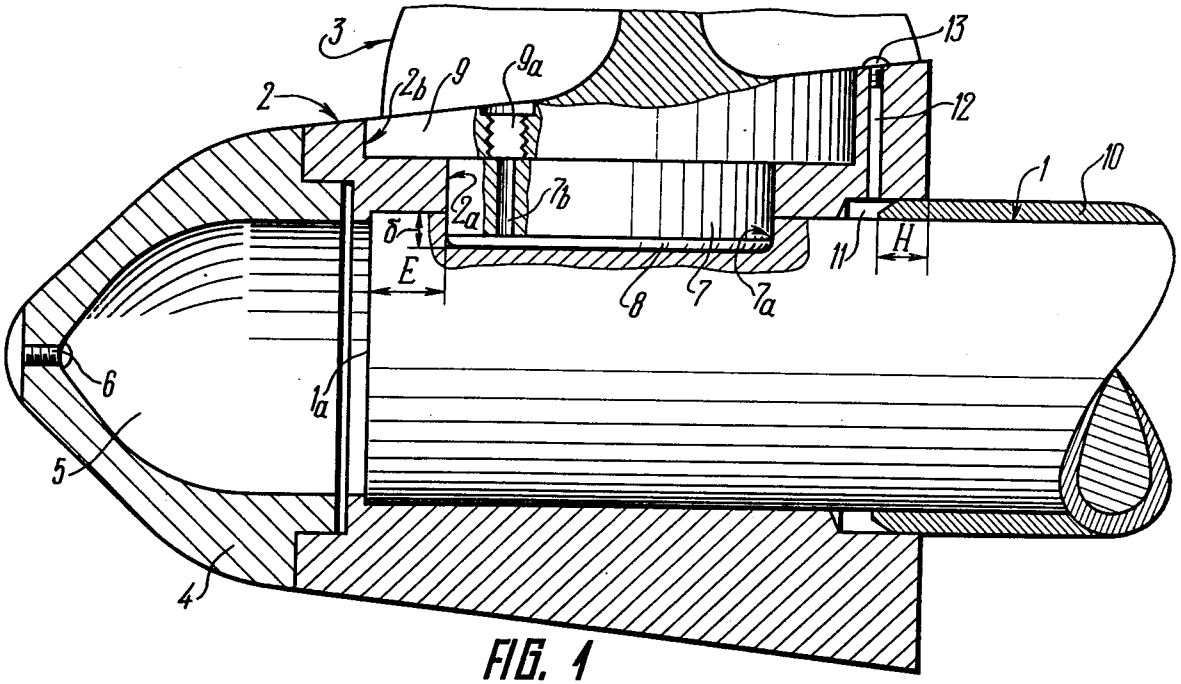

This invention relates generally to ship's machinery and is concerned more particularly with marine propulsive devices, wherein the propeller drive shaft is dismantled outwardly.

The invention is applicable to best advantage in icebreakers or in vessels with two or more propeller drive shafts.

Propulsive devices are known to extensively use a screw propeller, wherein the propeller drive shaft carries the screw propeller having the hub with radial holes for the propeller blade roots to hold.

In such marine propulsive devices the screw propeller hub has a tapered inside surface with which it is fitted onto a respective tapered portion of the propeller drive shaft extension, and is secured in position by a nut screwed onto the threaded tailpiece of the propeller drive shaft. To ensure against rotation of the hub relative to the propeller shaft, keyways are provided in both, wherein keys are fitted. After the screw propeller hub is secured to the propeller drive shaft, a respective propeller blade root is fixed in each radial hole of the hub.

An essential disadvantage inherent in the known marine propulsive devices resides in a relatively complicated construction of the aforesaid joint between the screw propeller hub and the propeller drive shaft that involves mating tapered surfaces (both male and female), as well as threaded and keyed joints which are not only labor-consuming in manufacture, as they involve manual fitting jobs, but also bring about some complications in mounting the screw propeller onto the propeller drive shaft or dismantling it therefrom.

All the above-mentioned disadvantages inherent in the known marine propulsive devices adversely affect their service life as they interfere with their repairs and render the latter less effective due to the fact that dismantling of the propeller hub from the propeller drive shaft by resorting to the known mechanical dismantling techniques may cause damage to their mating tapered surfaces as well as to the threaded joint or keyways, which damage will in turn lead to a premature wear of the components of the propulsive device in the course of its further operation.

It should be remembered also that a great proportion of breakdowns stem from cracking of the propeller drive shaft appearing at the point where it passes into the tapered portion on which the screw propeller hub is fitted. This is accounted for by stress concentration at the aforesaid area of the propeller drive shaft, brought about by a weakened cross-sectional strength of the latter due to provision of keyways therein, as well as on account of corroded surface of the propeller drive shaft resulting from disturbed tightness of the gland sealing occurring at the joint of the rust-preventer coating of the propeller shaft with the screw It is an essential object of the present invention to provide a marine propulsive device featuring such a propeller-to-shaft joint that would be less labor-consuming in manufacture and make it possible to facilitate and accelerate mounting the screw propeller onto the propeller drive shaft and dismantling it therefrom in the course of manufacture or repairs of both, which would protract the service life of the marine propulsive device as a whole.

Said object is accomplished in a marine propulsive device, wherein a propeller drive shaft carries a screw propeller having a hub with radial holes for the propeller blade roots to hold, in which according to the invention the screw propeller hub is shaped as a sleeve fitted onto the overhung shaft extension in such a manner that a free space is established between an end portion of said sleeve and the butt end of the propeller drive shaft, said space being communicated, through a two-way passage provided in the hub, with the outside surface of the latter, whereas each of the radial holes in the hub is made open-ended and is coaxial with the socket provided in the propeller drive shaft for the blade root end to hold.

Such an embodiment of the screw propeller hub makes it possible to do away with threaded and keyed joints, as well as mating tapered surfaces in the screw propeller-to-propeller shaft attachment unit, thus simplifying the construction of the propeller drive shaft and screw propeller as a whole and making unnecessary any fitting or retouching jobs in their manufacture or mounting. Furthermore, provision of a free space left between an end portion of the sleeve-shaped propeller hub and the butt end of the propeller drive shaft enables the hub to be dismantled by filling said space with a sluggish liquid pressure fed thereinto which facilitates and accelerates the process of dismantling the hub from the propeller drive shaft and protects both against any mechanical damage, thereby adding to service life thereof.

Besides, holding the blade root ends in the propeller drive shaft sockets makes it possible to reliably secure the screw propeller hub on the propeller drive shaft so as to ensure against possible displacement both lengthwise the shaft and round the axis thereof under the action of forces applied externally to the propeller blades, which is especially important in the case of large-sized screw propellers having a diameter in excess of 3 meters that are made use of on icebreakers.

Such an embodiment renders it possible to reduce the outside diameter of the screw propeller hub and cut down the weight thereof and of the screw propeller as a whole, thus increasing its efficiency.

It is expedient that a cylindrical boring be made in each of the radial holes of the propeller hub on the side of the outside surface of said hub coaxially with said radial hole, said boring being adapted for the propeller blade flange to hold therein.

Such an embodiment makes it possible to reduce still more the outside diameter of the propeller hub, since accommodation of the blade flange in the boring of the hub hole increases the area of their mating surfaces, thereby increasing the force holding the blade in the hub. Reduced outside diameter of the hub and lower weight thereof and of the screw propeller as a whole facilitate its balancing and makes it possible to carry out the latter with the use of standard equipment.

In addition, it is due to a reduced outside diameter of the propeller hub and lower weight thereof that the centre of gravity of the system "screw propeller — propeller shaft" is shifted towards the point of bearing of that system, thereby reducing the bending moment exerted upon the propeller drive shaft, which eventually adds to the service life of the propeller drive shaft and the stern-tube bearing.

When the propeller drive shaft is coated with a rust-proof material, a cylindrical boring coaxial with the propeller shaft may be made on the screw propeller hub end facing the coating, with which boring the hub is fitted onto said coating of the propeller drive shaft so as to define an annular gap communicated with the hub outside surface through a two-way passage made in the hub.

Such an embodiment enables a reliable sealing of the propeller drive shaft, thereby protecting it against corrosion. As a result, any sealing arrangements at the joint of the screw propeller hub with the rustproof coating of the propeller drive shaft are no longer necessary.

According to a next embodiment of the present invention, the hub bottom can be made detachable, and its outside surface can have streamlined shape.

Such an embodiment enables simplifying the production process of the hub and the technique of its mounting and dismantling which especially holds true of large-sized screw propellers.

According to one of the possible embodiments of the present invention, the mating surfaces of the screw propeller hub sleeve and the propeller drive shaft may be stepped throughout their length in such a manner that starting from the butt end of the propeller drive shaft, the diameter of the steps increases and their length decreases successively, while the length of the first step of the propeller drive shaft equals at least the length of its portion between the sockets made therein for holding the blade roots, and the butt end thereof.

Such an embodiment enables dismantling of the propeller hub from the propeller drive shaft with the blades completely taken down, since in this case the space in the hub remains hermetically sealed.

Figure 2:
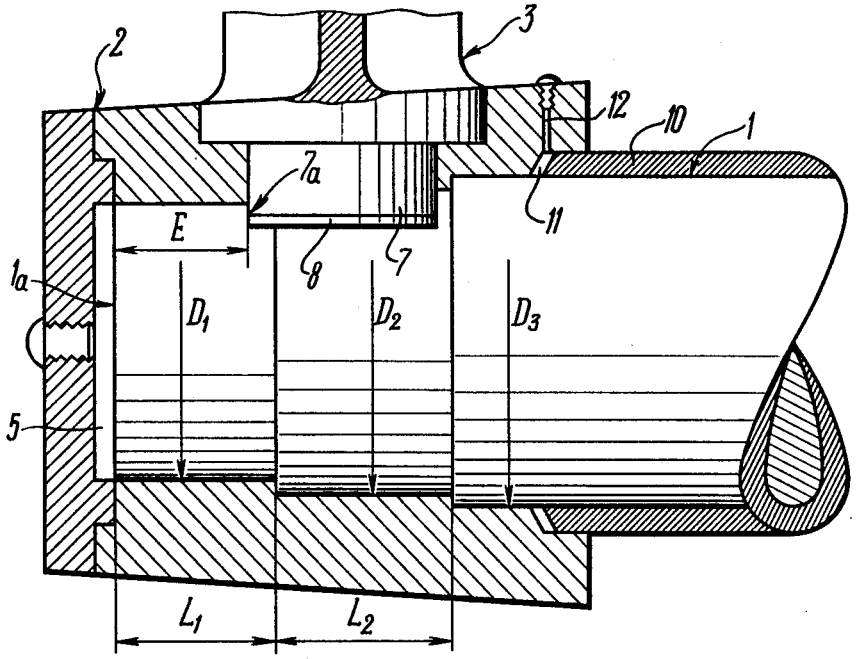

In what follows, the present invention is illustrated in a detailed disclosure of two possible embodiments thereof given with reference to the accompanying drawings, wherein:

FIG. 1 is general schematic longitudinal-section view of a marine propulsive device, according to the invention; and FIG. 2 is a longitudinal-section view of another embodiment of a marine propulsive device, according to the invention.

Now referring to FIGS. 1 and 2, the marine propulsive device of the invention comprises a propeller drive shaft 1 carrying at its overhung end a screw propeller which has a hub 2 and blades 3 secured thereon.

According to the invention, the hub 2 of the propeller drive shaft is shaped as a sleeve fitted onto the overhung end of the propeller drive shaft 1 in such a manner that a free space 5 is defined between the end portion 4 of the sleeve and a butt end 1a of the propeller drive shaft 1, said space being communicated through a two-way passage made in the end portion 4 of the hub 2 lengthwise the axis thereof, with the hub outside surface. The passage is tapped and is blanked from outside with a screw 6 in the course of operation of the present marine propulsive device.

Radially arranged cylindrical holes 2*a* are provided in the hub 2 of the propeller drive shaft for roots 7 of the propeller shaft blades 3 to hold therein.

According to the invention, each of said radial holes 2*a* in the hub 2 is made open-ended, while a blind cylindrical socket 7*a* coaxial with said hole is made in the propeller drive shaft 1. When the root 7 of the blade 3 is fitted into the open-ended hole 2a of the hub 2, the end of the root 7 of the blade 3 is fixed in the respective socket 7*a* of the propeller drive shaft 1, a definite clearance 8 being left between the butt of the root 7 and the bottom of the socket.

This makes it possible to minimize the interference between the propeller shaft 1 and the hub 2 of the screw propeller and due to this fact to reduce the outside diameter of the hub 2 and, accordingly, its weight, thus adding to the efficiency of the screw propeller as a whole.

Each of the radial holes 2*a* in the screw propeller hub 2, adapted for the root 7 of the blade 3 to hold therein according to the invention has a cylindrical boring 2*b* coaxial with said hole 2*a* made on the side of the outside surface of the hub 2, said boring being adapted for a flange 9 of the blade 3 to fix therein.

Two-way coaxial passages 9*a* and 7b are provided in the flange 9 and the root 7 of each blade 3 of the propeller drive shaft, adapted to communicate the clearance 8 between the butt of the root 7 of the blade 3 and the bottom of the socket 7*a* in the shaft 1, with the outside surface of the flange 9 of the blade 3.

When the propeller drive shaft 1 is clad with a rustproof material made, say, as a bushing 10, a cylindrical boring may be made in the butt of the screw propeller hub 2 facing said bushing, with which boring the hub 2 is fitted onto said bushing 10 so as to establish an annular space 11 therebetween, communicated through a two-way passage 12 in the hub 2, with the outside surface of the latter. Said passage 12 is blanked from outside with a screw 13 in the course of operation of the marine propulsive device.

The end portion 4 of the hub sleeve 2 is made detachable, its outside surface may have either streamlined (FIG. 1) or flat (FIG.2) shape, the latter being more preferable for large-sized screw propellers with a diameter exceeding 3 meters made use of for the most part on ice-breakers.

In such marine propulsive devices the mating surfaces of the screw propeller hub 2 (FIG. 2) and the propeller drive shaft 1, according to the invention, may be stepped throughout their length in such a way that beginning with the butt end 1a of the propeller drive shaft 1, the diameters $D_1$, $D_2$ and $D_3$ of the steps are successively increased, whereas the lengths $L_1$ and $L_2$ of the steps are successively decreased in the same direction, and the length $L_1$ of the first step of the propeller drive shaft should be somewhat greater than the length E of its portion lying between the surfaces of the sockets 7*a*, wherein the ends of the roots 7 of the screw propeller blades 3 are held, and the butt end 1*a* of the propeller drive shaft 1.

Assembly of the marine propulsive device according to either of the embodiments disclosed hereinbefore (FIGS. 1 and 2) begins with mounting the screw propeller hub 2 onto the extension of the propeller drive shaft, which is carried out using an interference fit which involves preheating of the hub 2 or refrigerating the extension of the propeller drive shaft 1 to a required temperature depending on the amount of designed interference.

Upon equalizing the temperatures of the propeller drive shaft 1 and the hub 2, the latter is held in position on the extension of the propeller drive shaft by virtue of contact-pressure forces.

In addition, the hub 2 with its cylindrical boring is likewise interference-fitted to a required depth "H" onto the end of the rustpreventer bushing 10 put onto the propeller drive shaft 1.

Thus, a reliable protection of the joint of the hub 2 with said bushing 10 is attained, whereby any gland seals can be dispensed with.

Said joint of the hub 2 with the bushing 10 is subject to pressure-tightness testing after assembling the marine propulsive device and regularly throughout its service period by force-feeding test sluggish liquid, such as kerosene, into the annular space 11 along the passage 12.

Upon mounting the screw propeller hub 2 onto the propeller drive shaft 1, a similar procedure is resorted to for the root 7 of the propeller blades 3 to hold in position in the respective open-ended radial holes 2*a* of the hub 2, while the ends of the roots 7 engage the sockets 7*a* of the propeller drive shaft 1, the clearance 8 being left between the butt of each of the roots 7 and the bottom of the respective socket 7*a* of the propeller drive shaft 1.

The roots 7 of the blades 3 are press-fitted in the respective holes of the hub 2 and in the sockets of the shaft 1 by being precooled in a required temperature, or after a corresponding preheating of the hub 2. In order to increase the bearing capacity of the joint "blade — hub", the flange 9 of each of the blades 3 is likewise press-fitted in the respective boring made in the hole of the hub 2.

To dismantle the screw propeller from the propeller drive shaft 1 the mounting procedure must be reversed.

As far as the former embodiment of the present marine propulsive device illustrated in FIG. 1 is concerned, the dismantling procedure begins with forcing out the roots 7 of the screw propeller blades 3 from the sockets 7*a* of the propeller drive shaft 1 for a full depth "δ" of said sockets 7*a* by force-feeding a sluggish liquid, such as oil, along the passages 9*a* (in the flanges 9 of the blades 3) and the passages 7*b* (in the roots 7 of the blades 3) coaxial therewith, to get into the clearance 8 between the butts of the roots 7 and the bottoms of the respective sockets 7*a* of the propeller drive shaft 1.

Thus, the interior space 5 of the hub 2 confined within its end portion 4 and the butt end 1*a* of the propeller drive shaft 1 is made pressure-tight during subsequent dismantling of the hub 2 which is carried out by force-feeding the oil into said cavity 5.

In another embodiment of the present marine propulsive device, wherein the mating surfaces of the propeller hub 2 and the propeller drive shaft 1 are made stepped as shown in FIG. 2, dismantling of the hub 2 is practiced with propeller blades 3 completely taken down.

The mating surfaces of the hub 2 and the shaft 1 may also be made taper-shaped (not shown in the drawing) which likewise enables dismantling of the propeller hub 2 with the blades 3 removed.

The end portion 4 of the screw propeller hub 2 may be detachable according to both embodiments discussed above, as shown in FIGS. 1 and 2; the end portion 4 can be dismantled likewise with the use of oil force-fed into the space 5 of the hub 2.

What we claim is:

1. A marine propulsive device, comprising a propeller drive shaft; a screw propeller secured on said propeller drive shaft and having a hub with cylindrical radial holes, and blades with roots which are held in said cylindrical radial holes, said hub of said screw propeller is made as a sleeve fitted onto an extension of the propeller shaft in such a manner that a space is established between the end portion of said sleeve and the butt end of the propeller drive shaft, said space being communicated, through a two-way passage in the end portion of said sleeve, with the outside surface of the sleeve and being adapted for feeding a liquid under pressure directly into said space in the course of hub dismantling, each of said cylindrical radial holes in the hub of said screw propeller being open-ended, and sockets coaxial with said cylindrical radial holes are provided in the propeller drive shaft for receiving and holding the end of the propeller blade roots, wherein said propeller drive shaft includes a bushing, a cylindrical boring coaxial with the propeller drive shaft is made in the propeller hub end facing said bushing; said hub is adapted to fit onto said bushing so as to define an annular space therebetween, said annular space communicating with the outside surface of said hub through a two-way passage provided in said hub.

2. A propulsive device as claimed in claim 1, wherein said bushing is rustproof.

* * * * *